US007052330B2

(12) United States Patent
Zhu et al.

(10) Patent No.: US 7,052,330 B2
(45) Date of Patent: May 30, 2006

(54) ELECTRICAL CONNECTOR HAVING CONDUCTIVE CONTACTS

(75) Inventors: ZiQiang Zhu, Kunsan (CN); Guohua Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/982,098

(22) Filed: Nov. 4, 2004

(65) Prior Publication Data

US 2005/0101195 A1 May 12, 2005

(51) Int. Cl.
*H01R 13/24* (2006.01)

(52) U.S. Cl. ..... 439/700; 439/635; 200/159

(58) Field of Classification Search ..... 439/635, 439/700; 200/159
See application file for complete search history.

(56) References Cited

U.S. PATENT DOCUMENTS 3,903,385 A * 9/1975 Moyer et al. ..... 200/51.1
4,118,094 A * 10/1978 Key ..... 439/635
4,467,160 A * 8/1984 Murmann et al. ..... 200/536
5,004,880 A * 4/1991 Koutaka ..... 200/521
5,008,505 A 4/1991 Takano et al.

FOREIGN PATENT DOCUMENTS

CN 02259756.5 9/2003

* cited by examiner

*Primary Examiner*—Truc Nguyen
(74) *Attorney, Agent, or Firm*—Wei Te Chung

(57) ABSTRACT

An electrical connector includes an insulative housing (4), an insulative carrier (1), a spring (3) and a pair of conductive contacts (2). The insulative housing has a base (41) and a periphery wall enclosing therearound and defines a cavity therein. The base has a post (414) formed thereon. The carrier engages with the insulative housing and has a projection (12) formed on an upper surface thereof. The spring couples with the post and abuts the carrier. The conductive contacts are received in the cavity and each includes a contacting portion (21) extending upwardly and engaging with the projection.

16 Claims, 6 Drawing Sheets

ELECTRICAL CONNECTOR HAVING CONDUCTIVE CONTACTS

BACKGROUND OF THE INVENTION

1. Field of the Invention

The present invention relates to an electrical connector, and particularly to an electrical connector having simple resilient contacts.

2. Description of Prior Art

Electrical connectors have been widely used in many applications, such as mobile phones, toys, cameras and so on. One electrical connector has been disclosed in CN Pat. No. 02259756. 5 and comprises an insulative housing, a plurality of terminals, a plurality of springs and a plurality of conductive contacts. The insulative housing comprises an upper wall and a lower wall. A plurality of through holes defines through the upper and lower wall for receiving the terminals. Each terminal has a metal pin, a spring and a conductive contact. The metal pin has an upper contact end, a middle-supporting portion and a lower column. The spring receives the lower column and has an upper end abutting against the support portion. The conductive contact comprises a contacting portion for contacting with a circuit board and a pair of contact arms extending upwardly to electrically contact with the metal pin.

Although this electrical connector works well, the terminals of the conventional electrical connector comprises too many elements and every terminal needs a spring, which makes the whole connector more complex and hard to assembly. It is requisite to provide an improved structure of an electrical connector for solving the problem.

BRIEF SUMMARY OF THE INVENTION

The primary purpose of the present invention is to provide an electrical connector having a simple structure, which can be easily manufactured and assembled.

To achieve the object, an electrical connector comprises an insulative housing, an insulative carrier, a spring, a pair of conductive contacts and a clip. The insulative housing has a base and a periphery wall enclosing therearound and defines a cavity therein, of which said base has a post forming on the upper surface. The carrier engages with the insulative housing and has a projection forming on the upper surface. The carrier further comprises a tang and a tab extending therefrom and abutting inner surface of the housing. The periphery wall defines an elongate groove, the tang further comprises a clasp engage with the groove. The spring couples with said post and abuts said carrier. The conductive contact embodies its main body in said cavity and comprises a contacting portion of which said contacting portion extending upwardly and coats on the upper surface of said projection.

To compare with the present technology, the merit of this invention is the carrier and the spring. The present invention defines a structure of only one carrier and only one spring. A pair of projections are formed on the insulative carrier for engaging the contacts. The spring abuts the carrier and enables the carrier to restore to the normal statues.

DETAILED DESCRIPTION OF THE PREFERRED EMBODIMENT

Figure 1:
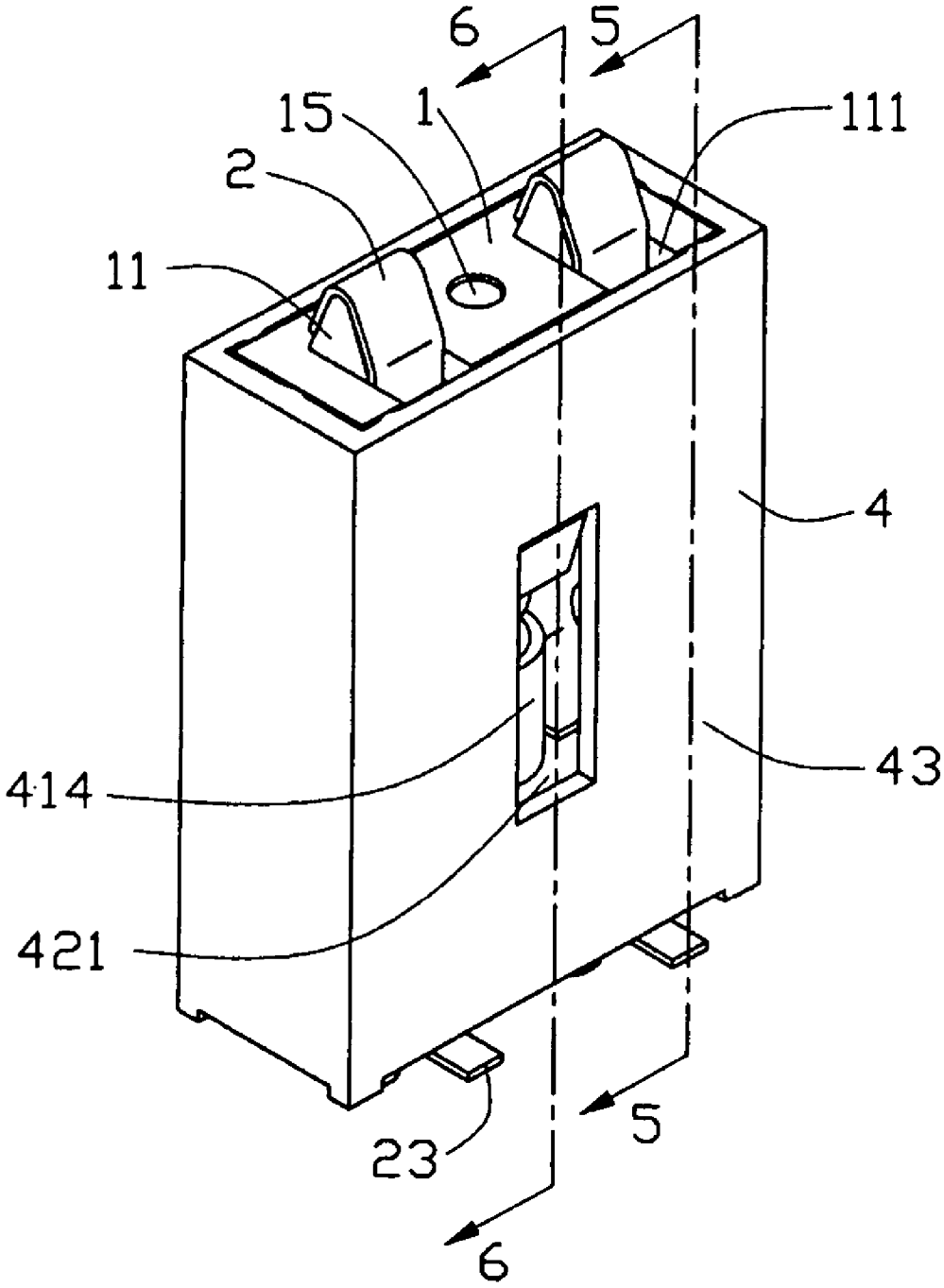
FIG. 1 is an assembly view of an electrical connector in according with this invention.
Figure 2:
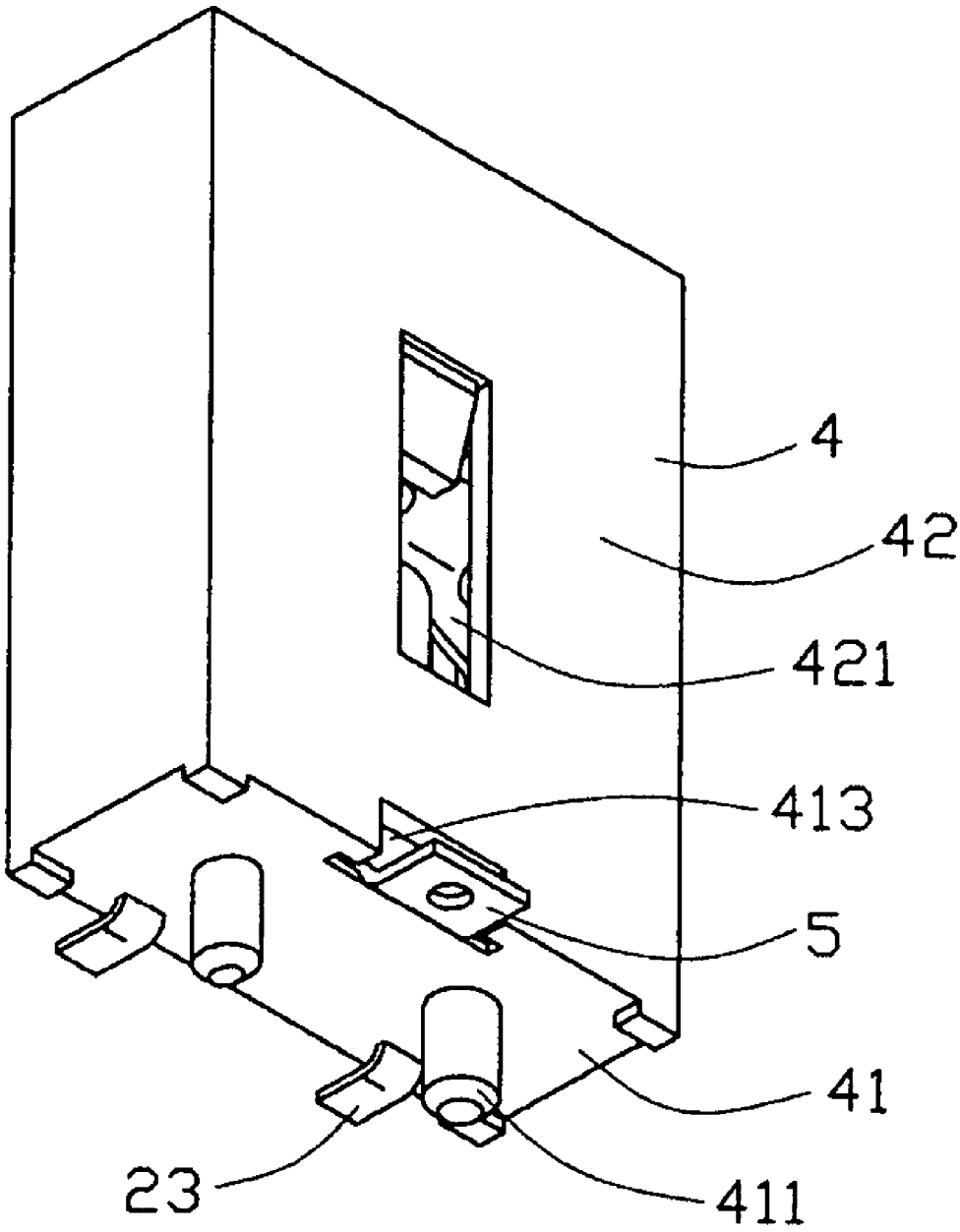
FIG. 2 is another perspective view of FIG. 1.
Figure 3:
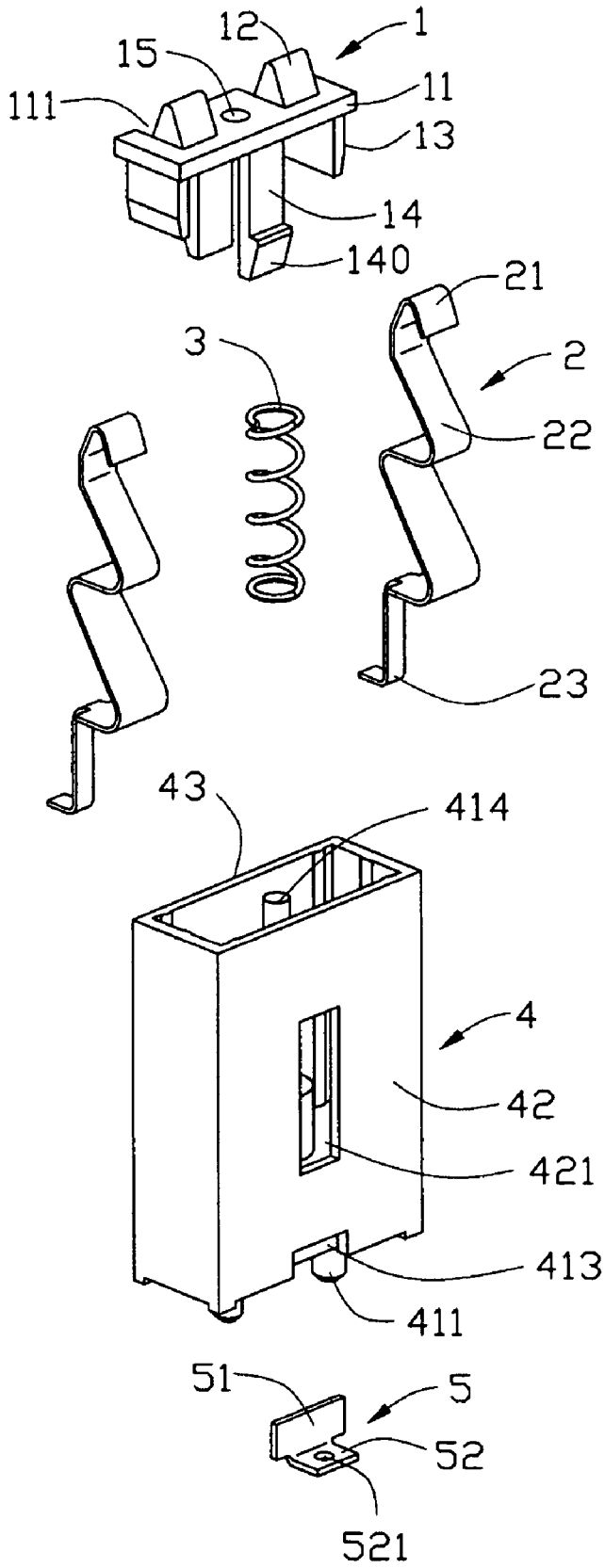
FIG. 3 is an exploded view of FIG. 1.
Figure 4:
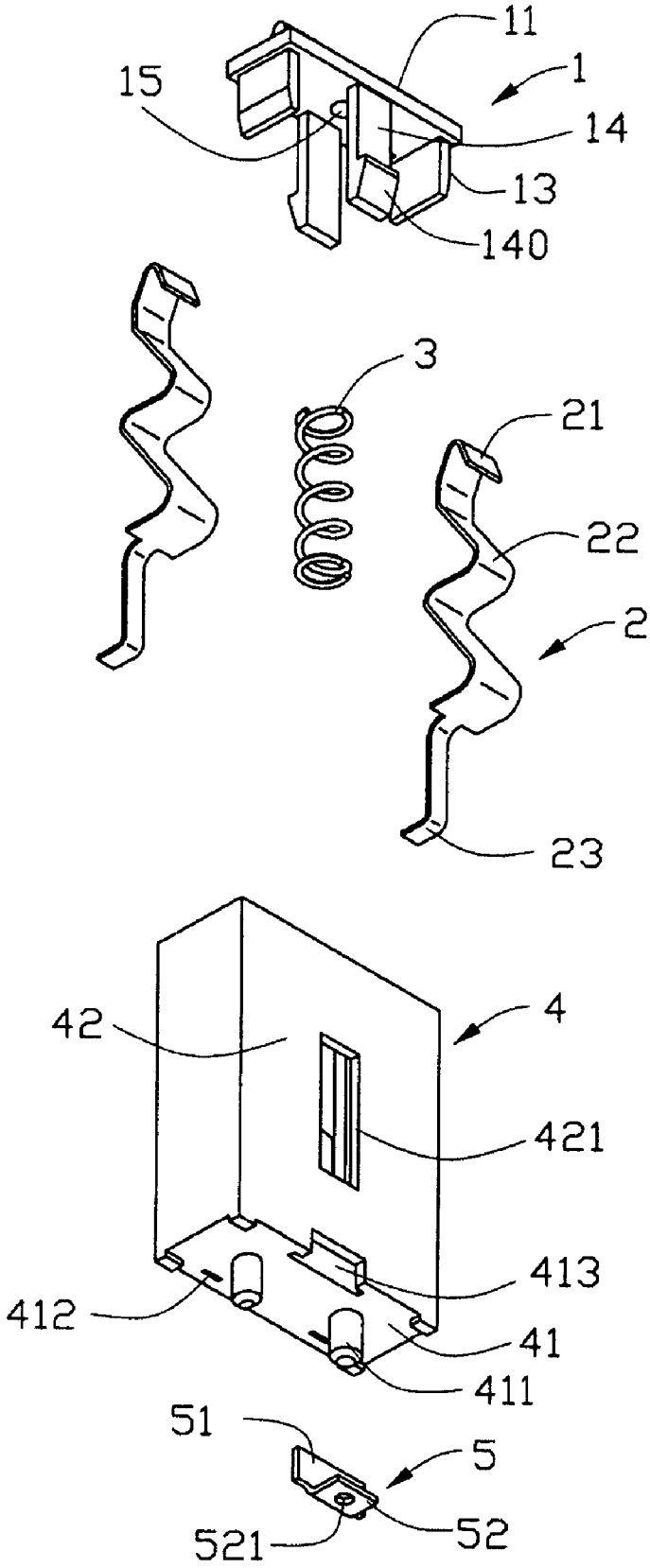
FIG. 4 is an exploded view of FIG. 2.

Referring to FIGS. 3 and 4, an electrical connector comprises an insulative housing 4, an insulative carrier 1, a spring 3, a pair of conductive contacts 2 and a clip 5.

Figure 5:
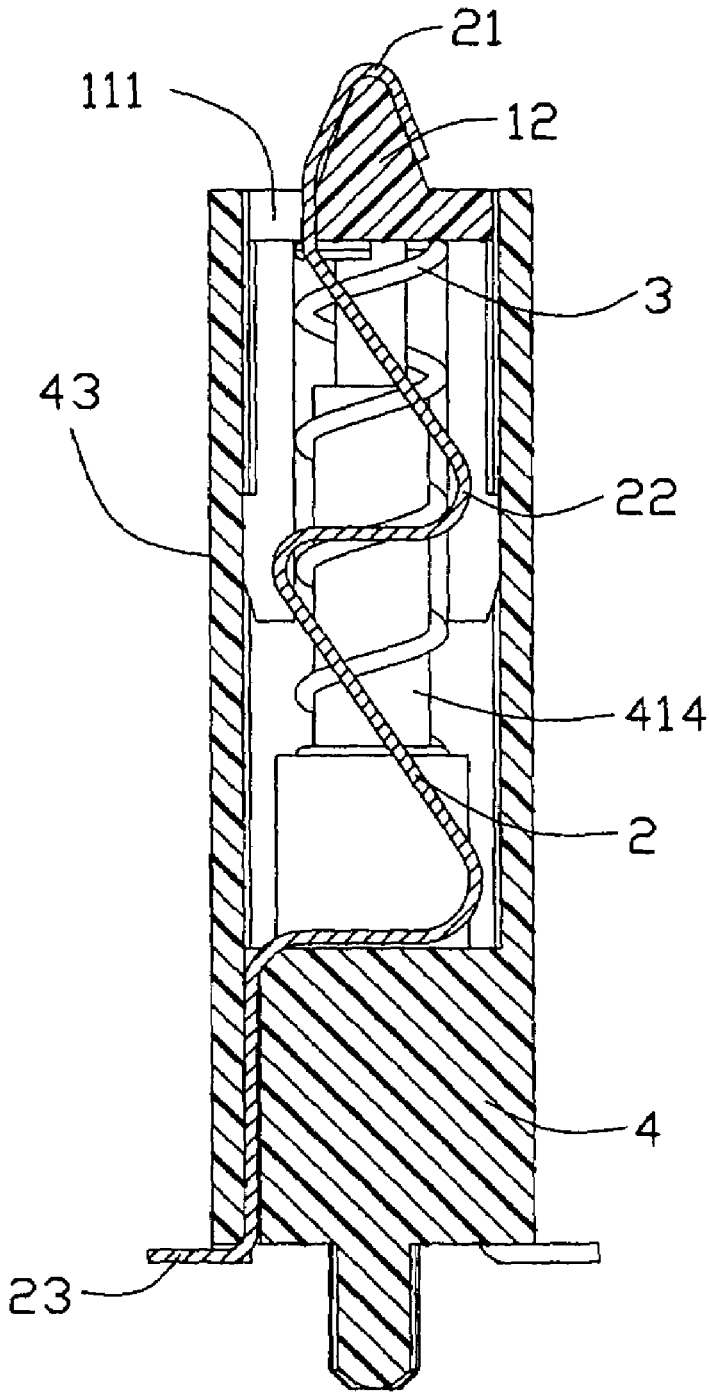
FIG. 5 is a cross-sectional view taken from line 5—5 of FIG. 1.
Figure 6:
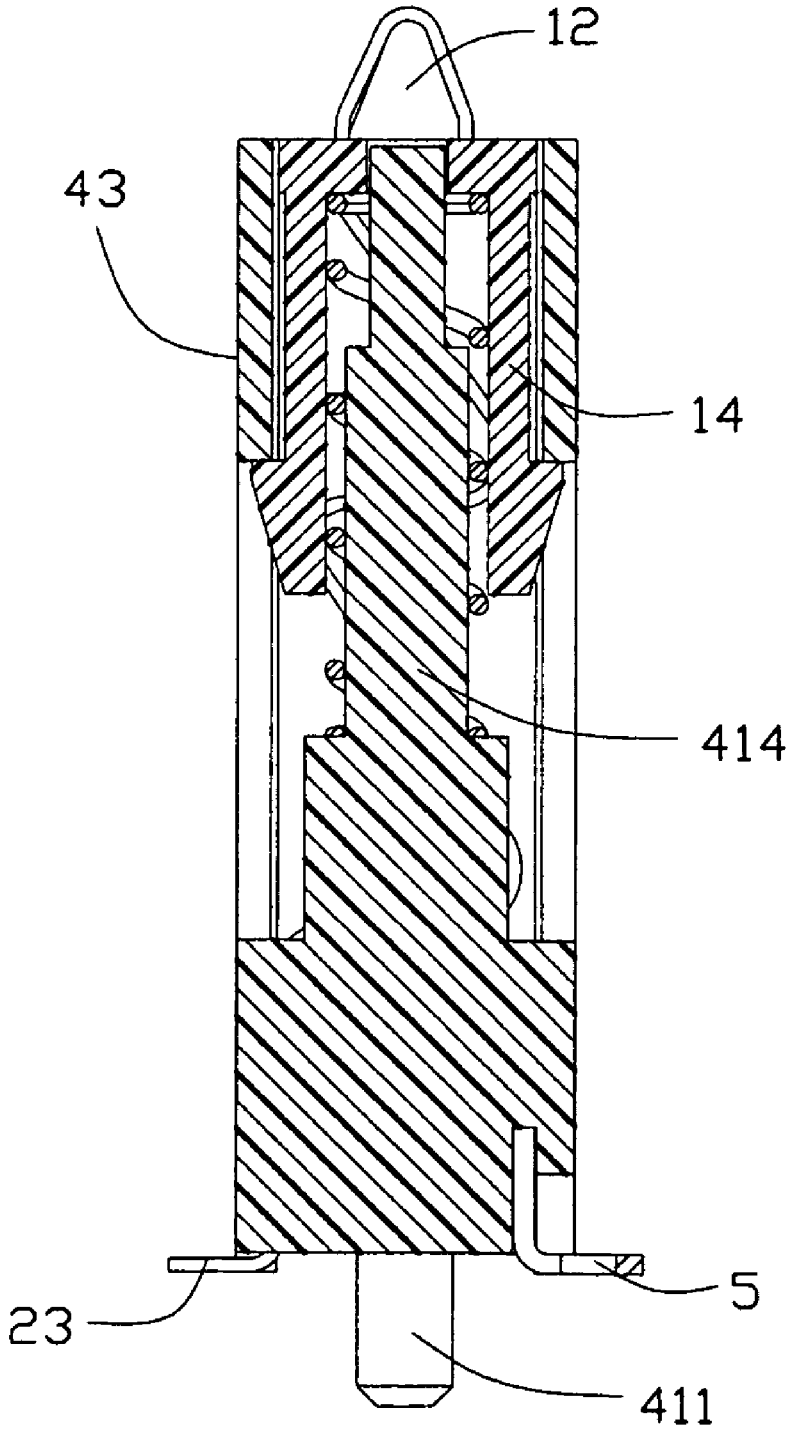
FIG. 6 is a cross-sectional view taken from line 6—6 of FIG. 1.

Also referring to FIGS. 3 and 4, the housing 4 has a bottom base 41. The base 41 has a pair of mounting poles 411 symmetrically located on a longitude central axis thereof and extending downwardly therefrom. A pair of slits 412 are defined through the base 41 and are adjacent to corresponding mounting poles 411 and nearing the rear lever edge. A plurality of standoffs (not labeled) project downwardly from four corners of the base 41. A recess 413 is defined at the front lever edge of the base 41 and is forwardly exposed. A post 414 is built on an upper surface of the base 41. The post 414 comprises several columns (best shown in FIG. 5), wherein one column builds on the upper surface of another larger column and one by one. The largest column extends from the base 41 and is larger than the spring 3 in radius for supporting the spring 3 thereon. A periphery wall extends upwardly from and encloses the base 41 and defines a cavity (not labeled) therebetween. The periphery wall comprises opposite front and rear walls 42 and 43 and opposite left and right walls (not labeled). Two elongate grooves 421 are respectively defined through the front wall 42 and the rear wall 43 and extend in top-to-bottom directions.

The insulative carrier 1 has a substantially planar plate body 11 and defines a through hole 15 in the central thereof. The planar plate body 11 is movable in the housing 4 in top-and-bottom directions. A pair of projections 12 symmetrically and upwardly project from the planar plate 11 and have substantially gable roof configuration. Two cutouts 111 are cut away from the rear lever edge of the planar plate body 11 corresponding to the projections 12. Two tabs 13 extend downwardly from opposite side ends of the lower surface of the planar plate body 11 and are parallel to each other for abutting against the inner surfaces of the left and right walls of the housing 4. Two tangs 14 extend respectively and downwardly from front and rear portions of the lower surface of the planar plate body 11. The tangs 14 have clasps 140 extending vertically toward corresponding front and rear walls 42, 43 from distal ends thereof thereby forming hooks for engaging with the elongate grooves 421. The tangs 14 abut against the inner surfaces of the front and rear walls 42, 43 of the housing 4 with the clasps 140 movably received in the grooves 421.

The spring 3 couples with post 414 and is supported on the largest column of the post 414. The second largest column is somewhat smaller than the spring 3 in radius, so that the spring 3 can movably engage with the second largest column. The conductive contact 2 is made of flexible material and has a contacting portion 21, a resilient wave portion 22 and a mounting bent end 23. The contacting portion 21 has a V-shaped configuration and extends upwardly through the cutout 111 to coat the upper surface of the projection 12. The resilient wave portion 22 comprises a plurality of waves, which is made to provide flexibility with the conductive contact 2 and ensures the conductive contact 2 to be movable in top-and-bottom directions. The mounting bent end 23 extends downwardly beyond the slits 412 from a lower end of the resilient wave portion 22 and then extends rearward to form a bent.

The clip 5 comprises two rectangular planar plates 51 and 52 and vertical plate 51 is wider than the horizontal plate 52. The horizontal plate 52 defines a hole 521 at the central thereof. The clip 5 is combined with the base 41 by insert molding.

In assembly, the conductive contacts 2 engage with the carrier 1 and the contacting portions 21 extend upwardly from the cutouts 111 and coat tightly on the upper surfaces of the projections 12, meanwhile, the bent ends 23 insert into the slits 412 of the base 41. The spring 3 couples with the post 414. The carrier 1 engages with the housing 4 of which the tabs 13 and tangs 14 abut the inner surfaces of the two sidewalls and front and rear walls of the housing 4, the clasp 140 engage with the grooves 421. The upper column of the post 414 engages with the through hole 15 and the spring 3 abuts the lower surface of the plan plate 11 there. The spring 3 is somewhat contracted. The clip 5 is mounted in the housing 4 and the vertical portion 51 is inserted molding in the base 41. The mounting pole 411 is fixed to the circuit board (not shown) and the clip 5 is welded there.

In operation, an electrical element (not shown) is pressed on the contacting portions 21 coating on the projections 12, and the press enable the carrier 2 to move down in the cavity of the housing 4 and causes the spring 3 and conductive contacts 2 to contract themselves until the carrier 2 abuts on a medium column of the post 414. The clasps 140 longitudinally move in the grooves 421. If released, the spring 3 restores to a normal status, and pushes the carrier 2 with contacting portion 21 of the cover 2 moves upwardly to normal position.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein.

We claim:

1. An electrical connector comprising:

an insulative housing having a base and a periphery wall enclosing therearound and defining a cavity therein, said base having a post projecting into the cavity;

a carrier movably received in the cavity of the insulative housing and having a projection forming on an upper surface;

a spring received in the cavity of the insulative housing and coupling with said post and abutting said carrier; and a conductive contact comprising a contacting portion engaging with said projection of the carrier, a middle resilient portion received in the cavity of the housing and a mounting portion extending beyond the housing.

2. The electrical connector as claimed in claim 1, wherein the carrier further comprises a tang embodied in the cavity and abutting against the periphery wall of the housing.

3. The electrical connector as claimed in claim 2, wherein said periphery wall defines an elongate groove, and the tang further comprises a clasp engaging with the groove.

4. The electrical connector as claimed in claim 1, wherein said base comprises a mounting pole extending from a lower surface of the base of the housing.

5. The electrical connector as claimed in claim 1, wherein said base defines a recess, and wherein the electrical connector comprises a clip received in the recess.

6. The electrical connector as claimed in claim 1, wherein said carrier is movable in the housing in top-to-bottom directions.

7. The electrical connector as claimed in claim 1, wherein said carrier has a tab engaging with the housing.

8. The electrical connector as claimed in claim 1, wherein the base defines a slit therein, the mounting portion extending outside the housing through the slit.

9. The electrical connector as claimed in claim 1, wherein the carrier defines a through hole engaging with the post.

10. An electrical connector comprising:

an insulative housing defining therein a cavity with an opening to communicate with an exterior;

a carrier disposed in the cavity and moveable in a direction perpendicular to said opening;

at least one resilient conductive contact defining one end section fixedly located in the housing, and an opposite end section associatively moveable with the carrier; and a biasing device being discrete from the conductive contact and engaged with the carrier to urge the carrier to block the opening; wherein said contact is deformable in said direction when said carrier is moved along said direction.

11. The electrical connector as claimed in claim 10, wherein said contact is compressible in said direction.

12. The electrical connector as claimed in claim 10, wherein said carrier is insulative, and the contact defines a contacting portion exposed on an exterior surface of the carrier.

13. An electrical connector comprising:

an insulative housing defining therein a cavity with an opening to communicate with an exterior;

a insulative carrier disposed in the cavity and moveable in a direction perpendicular to said opening;

at least one resilient conductive contact defining one end section fixedly located in the housing, and an opposite end section associatively moveable with the carrier and located outside the cavity and directly exposed to said exterior; and a biasing device engaged with the carrier to urge the carrier to block the opening; wherein the opposite end section is moved with the carrier in said direction when said carrier is moved along said direction.

14. The connector as defined in claim 10, wherein the opposite end section is located outside of the cavity and directly exposed on an exterior surface of the carrier.

15. The connector as defined in claim 10, wherein said opposite end section is attached to the carrier.

16. The connector as defined in claim 14, wherein said opposite end section is attached to the carrier.

* * * * *